US005336081A

United States Patent [19]

Saito et al.

[11] Patent Number: 5,336,081

[45] Date of Patent: Aug. 9, 1994

[54] DEVICE AND METHOD FOR REMOVING NITROGEN OXIDES

[75] Inventors: Hirohisa Saito; Jeremy P. Hoblyn; Etsuo Abe, all of Tokyo, Japan

[73] Assignee: Bluenox Japan Kabushiki Kaisha, Tokyo, Japan

[21] Appl. No.: 982,694

[22] Filed: Nov. 24, 1992

[51] Int. Cl.[5] ..... F23J 7/00

[52] U.S. Cl. ..... 431/4; 431/190; 110/342; 110/348

[58] Field of Search ..... 431/4, 190; 432/181, 432/214, 215; 110/347, 348, 238, 342

[56] References Cited

U.S. PATENT DOCUMENTS 4,714,032 12/1987 Dickinson ..... 431/4 X
4,824,441 4/1989 Kindig ..... 431/4 X
4,842,617 6/1989 Kukin ..... 431/4 X
5,118,282 6/1992 Reynolds et al. ..... 431/4
5,217,373 6/1993 Goodfellow ..... 431/4 X

*Primary Examiner*—Larry Jones
*Attorney, Agent, or Firm*—Skjerven, Morrill, MacPherson, Franklin & Friel

[57] ABSTRACT

In a device for removing nitrogen oxides from exhaust gas of a combustion device by spraying a treatment agent capable of chemically reducing nitrogen oxides contained in the exhaust gas from an injector in a combustion chamber or an exhaust passage of the combustion device, the effectiveness of the treatment agent is optimized by detecting a combustion condition of the combustion device, and supplying water and at least one treatment agent in a selective and alternating manner according the detected combustion condition.

18 Claims, 7 Drawing Sheets

HC : Host computer
MC : Main controller
MXC : Mixing controller
MXT : Mixing tank HC : Host computer
MC : Main controller
MXC : Mixing controller
MXT : Mixing tank

DEVICE AND METHOD FOR REMOVING NITROGEN OXIDES

TECHNICAL FIELD

The present invention relates to a device for removing nitrogen oxides from exhaust gas of a burner or other combustion device.

BACKGROUND OF THE INVENTION

Conventionally, various devices have been proposed for removing or reducing the concentration of nitrogen oxides (NOx) in a combustion device, and it is proposed in Japanese patent laid open publication No. 63-502086 corresponding to WO87/02025 to decompose the nitrogen oxides contained in the exhaust gas into nitrogen gas, carbon dioxide and water by spraying a water solution of urea into the exhaust gas at a temperature higher than 2,000° F. According to this process, the concentration of nitrogen oxides can be relatively easily reduced from the exhaust gas of a combustion device such as a boiler simply by spraying a water solution of urea into the exhaust gas.

The applicants of this patent application proposed in Japanese patent laid open publication No. 63-502087 corresponding to WO87/02024 to remove nitrogen oxides from exhaust gas at a temperature level of approximately 1,600° F. by adding oxygen-containing hydrocarbons into the water solution of urea that is to be sprayed into the exhaust gas. Other liquid treatment agents have since been proposed for effectively chemically reducing or de-oxidizing the nitrogen oxides contained in exhaust gas at even lower temperatures.

However, when such agents for reducing nitrogen oxides from exhaust gas are used, it is necessary to conduct the combustion process in the combustion device in a highly controlled condition for the agents to be effective in removing the nitrogen oxides. Therefore, from a practical viewpoint, it has been difficult to achieve the desired result which these agents are capable of producing.

This disadvantage can be overcome by carefully controlling the combustion condition of the combustion device but this approach limits the usefulness of the combustion device or substantially increases the cost for operating the combustion device. Further, there is a need to carefully control the concentration and the amount of the agent depending on the combustion condition. However, not only is such a control difficult to achieve by controlling the operation of the feed pump for the agent but also the system for carrying out such a control requires complex and large hardware components. An alternative approach is to use a plurality of such agents and mix them in different compositions depending on the combustion condition, but this also causes increases the complexity and the size of the overall system.

BRIEF SUMMARY OF THE INVENTION

In view of such problems of the prior art, a primary object of the present invention is to provide a device and method for removing nitrogen oxides from effluent or exhaust Gas of a burner or other combustion device which allows nitrogen oxides contained in the exhaust gas to be removed in a highly efficient way even when the operating condition of the combustion device or the combustion condition changes.

A second object of the present invention is to provide a device for removing nitrogen oxides which is compact and simple in structure.

A third object of the present invention is to provide a device for removing nitrogen oxides which can be automated so as to minimize the need for human attendance.

These and other objects of the present invention can be accomplished by providing a device for removing nitrogen oxides from exhaust gas of a combustion device by spraying a treatment agent from an injector into a combustion chamber or an exhaust passage of the combustion device, the treatment agent being capable of chemically reducing nitrogen oxides contained in the exhaust gas, comprising: means for detecting a combustion condition of the combustion device; a tank for storing the treatment agent; pump means having an inlet which may be connected either to water supply means or to the tank in a selective manner by switching means, and an outlet for supplying either water or the treatment agent to the injector; and means for controlling the switching means according to the combustion condition detected by the detecting means.

Thus, according to the present invention, the concentration of the treatment agent having the capability to chemically reduce nitrogen oxides and the amount of supply of the treatment agent to the nozzle of the injector can be controlled at high speed in an optimum fashion according to the combustion conditions such as combustion temperature, the load of the combustion device, the concentration of a component in the exhaust gas and so forth. Further, the structure and the process for adjusting the flow rate of each of the treatment agents can be simplified and reduced in size.

When the treatment agent is prepared by combining a plurality of components, mixing of such components can be conveniently carried out while water is being supplied to the injector. Therefore, the components may be safely introduced into a mixing tank in a sequential manner without disturbing composition of the treatment agent as it is supplied to the injector because the outlet of the mixing tank communicating with the injector is kept closed during the mixing process. Further, in addition to the advantage of increasing the response speed of the system, the size of the mixing tank may be reduced because the treatment agent may be prepared in small doses during the operation of the system. The reduction in the size of the mixing tank obviously contributes to the reduction of the overall size of the system.

The detecting means may consist of means for detecting the concentration of at least one component in the exhaust gas, means for detecting temperature of the exhaust gas in the vicinity of the injector and/or means for detecting a load condition of the combustion device.

According to a preferred embodiment of the present invention, the combustion device comprises a post-heater provided in an exhaust passage of an internal combustion engine.

BRIEF DESCRIPTION OF THE DRAWINGS

The present invention is described in the following with reference to the appended drawings, in which.

DETAILED DESCRIPTION OF THE PREFERRED EMBODIMENTS

Figure 1:
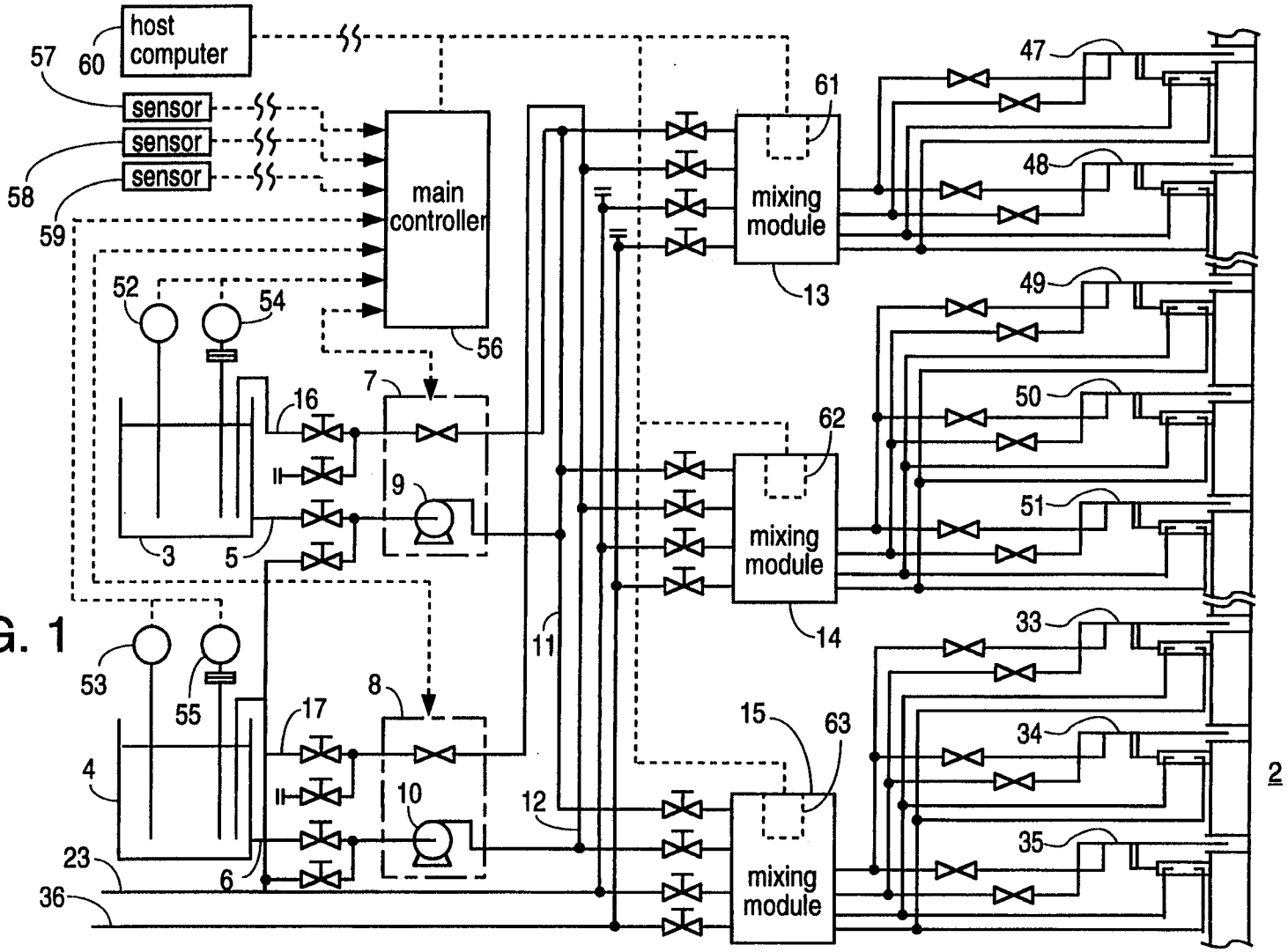
FIGS. 1 and 2 are schematic diagram showing the structure of a boiler to which the present invention is applied.

FIG. 1 shows the general structure of a first embodiment of the nitrogen oxides removal device according to the present invention which is applied to a boiler. A combustion chamber 2 is defined in the interior of a boiler 1, and a burner unit not shown in the drawings is provided in this combustion chamber 2. Fire tubes are arranged in suitable parts of the combustion chamber 2 for heating the water passed therethrough.

In a part remote from the boiler 1 are provided a storage tank 3 for storing a first treatment agent consisting of water solution of urea and another storage tank 4 for storing a second treatment agent consisting of compounds that are to be added to the first treatment agent. The lower ends of the storage tanks 3 and 4 are connected, via conduits 5 and 6, to pump modules 7 and 8 having first pumps 9 and 10, respectively. Each of the pump modules 7 and 8 are connected to three mixing modules 13 through 15 via conduits 11 and 12. The conduits 11 and 12 are connected to return conduits 16 and 17, respectively, for returning excess agents to the storage tanks 3 and 4, respectively.

The second agent contained in the storage tank 4 consists of an additive for allowing the water solution of urea in the storage tank 3 to be capable of removing nitrogen oxides even under relatively low temperatures, and may contain one or more compounds selected from hexamethylenetetramine, lower alcohols, a hydroxy amino hydrocarbon, a sugar, furfural, a furfural derivative, an amino acid, a protein-containing composition, guanidine, guanidine carbonate, biguanidine, guanylurea sulfate, melamine, dicyandiamide, calcium cyanamide, biuret, 1,1'-azobisformamide, methyl urea, and dimethyl urea. By adding the second agent to the first agent, the mixture flowing through the conduits 28, 31, 31*a*, 31*b* and 31*c* is prevented from freezing in winter, thereby removing the need to provide a heater or other warming structures for the conduits. This contributes to the simplification of the overall structure of the device.

The mixing modules 13 through 15 are provided with a substantially identical structure, and, therefore, only one of them 15 is now described in the following with reference to FIG. 2.

The mixing module 15 is internally provided with a mixing tank 20 which, for instance, may have the capacity of 3 liters. Conduits 11*a* and 12*a* branching off from the conduits 11 and 12, respectively, and provided with solenoid valves 21 and 22, respectively, are connected to an upper portion of the mixing tank 20. Further, a conduit 23*a* branching off from a utility water conduit 23 and provided with a solenoid valve 24 is also connected to an upper part of the mixing tank 20. The end portions of these branch conduits 11*a*, 12*a* and 23*a* are provided with respective filters 79 through 81.

The utility water conduit 23 is connected to an inlet end of a second pump 26 consisting of a gear pump via a solenoid valve 25. A conduit 28 extending from a lower part of the mixing tank 20 is connected, via a one-way valve 29, to a part of the utility water conduit 23 located between the inlet end of the second pump 26 and the solenoid valve 25. The outlet end of the pump 26 is connected to a plurality of parallel injectors 33 through 35 provided in a somewhat downstream location of the combustion chamber 2 via a conduit 31, a one-way valve 32 and branch conduits 31*a* through 31*c*. Thus, by switching on and off the solenoid valve 25, it is possible to selectively connect the plant utility water supply conduit 23 or the mixing tank 20 to the injectors 33 through 35 so as to supply thereto water or the mixed treatment agent. The injectors are also connected to a branch conduit 36*a* of a utility air supply conduit 36 via a pressure regulating valve 37, a solenoid valve 38 and a one-way valve 39 so that the mixed treatment agent may be ejected from the injectors 33 through 35 by means of air supplied from a plant utility air source via the air supply conduit 36.

The injectors 33 through 35 are installed in the combustion chamber 2 or in an exhaust passage thereof so as to be pushed into and retracted out of the combustion chamber 2 by suitable guide means not shown in the drawings. Each of the injectors 33 through 35 is supported by an associated one of air cylinders 40 through 42 which are connected to the plant air supply conduit 36 via a pressure regulating valve 43, a switching valve 44 and branch conduits 36*b* and 36*c* so that the pressurized air may be supplied to each of the cylinders 40 through 42 as desired. By appropriately controlling the switching valve 44, it is possible to project the injectors 33 through 34 into the combustion chamber 2 when they are in use, and to retract them when they are not in use.

A yet another branch conduit 36*d* is connected to an intermediate part of the branch conduit 36*b* to connect the branch conduit 36*b* to the interior of the mixing tank 20 via a flow rate control valve 45 and a one-way valve 46. By using the air ejected from the branch conduit 36*d*, the mixed agent in the mixing tank 20 is favorably stirred whenever the mixed agent is being ejected from the injectors 33 through 35.

Referring to FIG. 1, the mixing module 13 is connected to two injectors instead of three. Each of the mixing modules 13 and 14 is otherwise similar to the mixing module 15 in structure, and the injectors 47 through 51 connected to these are likewise similar to the aforementioned injectors 33 through 35.

Each of the storage tanks 3 and 4 is provided with a temperature sensor 52 or 53 and a level sensor 54 or 55, which are electrically connected to a main controller 56 for controlling the operation of the nitrogen oxides removal device. The main controller 56 detects the output pressure from each of the pumps 9 and 10, and is connected to terminal devices (not shown in the drawings) associated with the pump modules 7 and 8. The main controller 56 is also connected to a flow rate sensor 57 for detecting the fuel flow rate serving as the load of the boiler 1, concentration sensors 58 provided in a downstream part of the exhaust passage 2 for detecting the concentrations of nitrogen oxides (NOx), ammonia (NH3), carbon monoxide (CO), oxygen and so on, and a temperature sensor 59 for detecting the temperature of the interior of the boiler 2 at the locations near the injectors 33 through 35 and 47 through 51. The main controller 56 is further connected to a host computer 60 consisting of a main body, a display unit, an external storage device such as a hard disk drive, a printer and a keyboard for entering commands and parameters and monitoring the operating conditions of the system, and mixing controllers 61 through 63 for detecting the conditions of the mixing modules 13 through 15 and controlling the pumps and the solenoid valves, via a network system.

Figure 2:
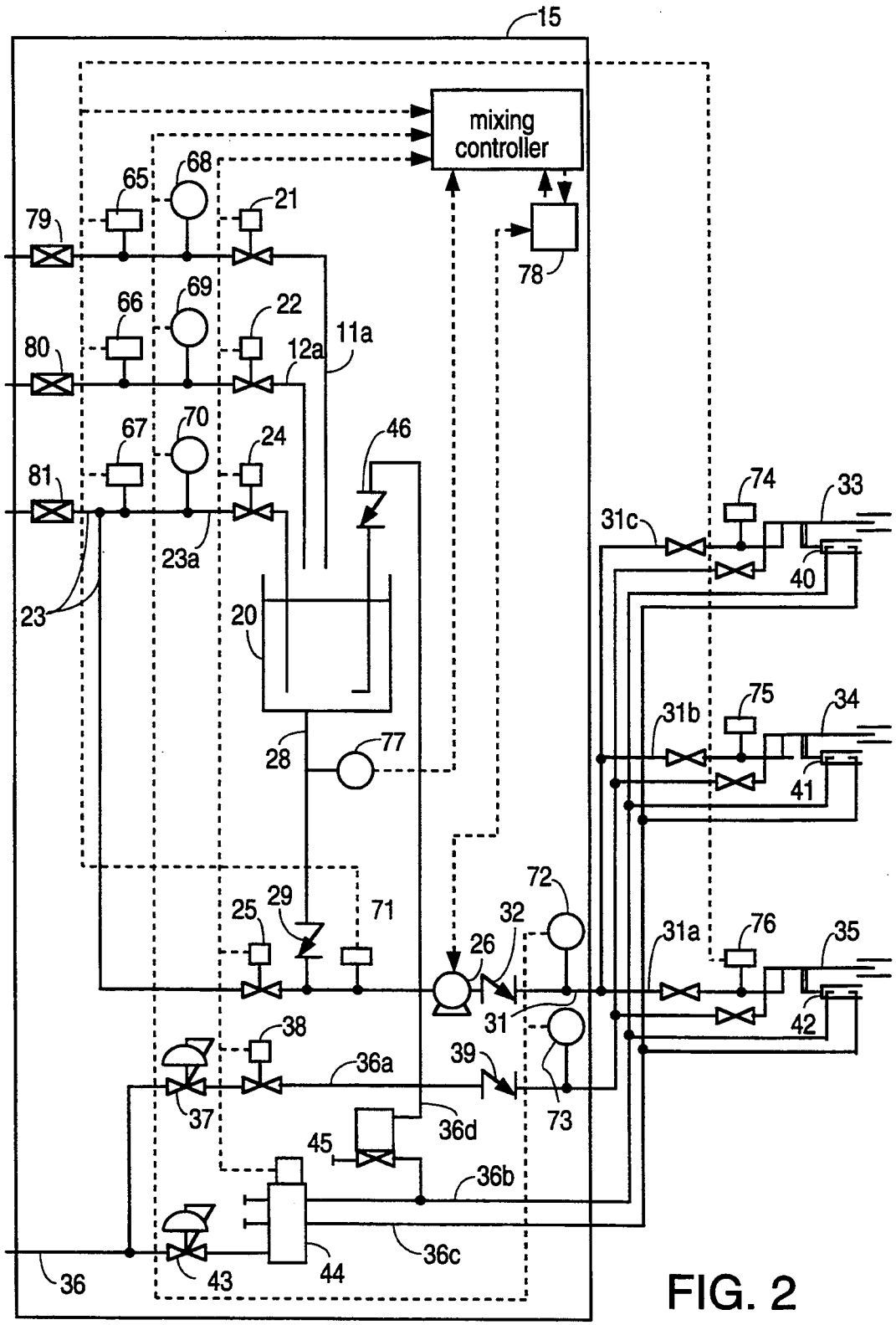

Referring to FIG. 2, the mixing controller 63 is connected to flow rate sensors 65 through 67 associated with the conduits 11*a*, 12*a* and 23*a*, respectively, pressure sensors 68 through 70 likewise associated with the conduits 11*a*, 12*a* and 23*a*, respectively, a flow rate sensor 71 associated with the conduit 23, a pressure sensor 72 associated with the conduit 31, a pressure sensor 73 associated with the conduit 36*a*, flow rate sensors 74 through 76 associated with the branch conduits 31*a*, 31*b* and 31*c*, respectively, which connect the common conduit 31 to the injectors 33 through 35, respectively, and a level switch 77 associated with the conduit 28, for the purpose of monitoring the flow rates, pressures and temperatures of these conduits.

The mixing controller 63 is connected to the solenoid valves 21, 22, 24, 25, 38 and 44 provided in the associated conduits 11*a*, 12*a*, 23*a*, 23, 36*a*, 36, 36*b* and 36*c*, respectively, to open and close them as required. The mixing controller 63 controls the pump 26 via a pump driver 78. The mixing controllers 61 and 62 are not described here because they are similar to the mixing controller 63.

The operation of the host computer 60, the main controller 56 and the mixing controllers 61 through 63 is described in the following by referring to the flow charts of FIGS. 3 through 5.

Figure 3:
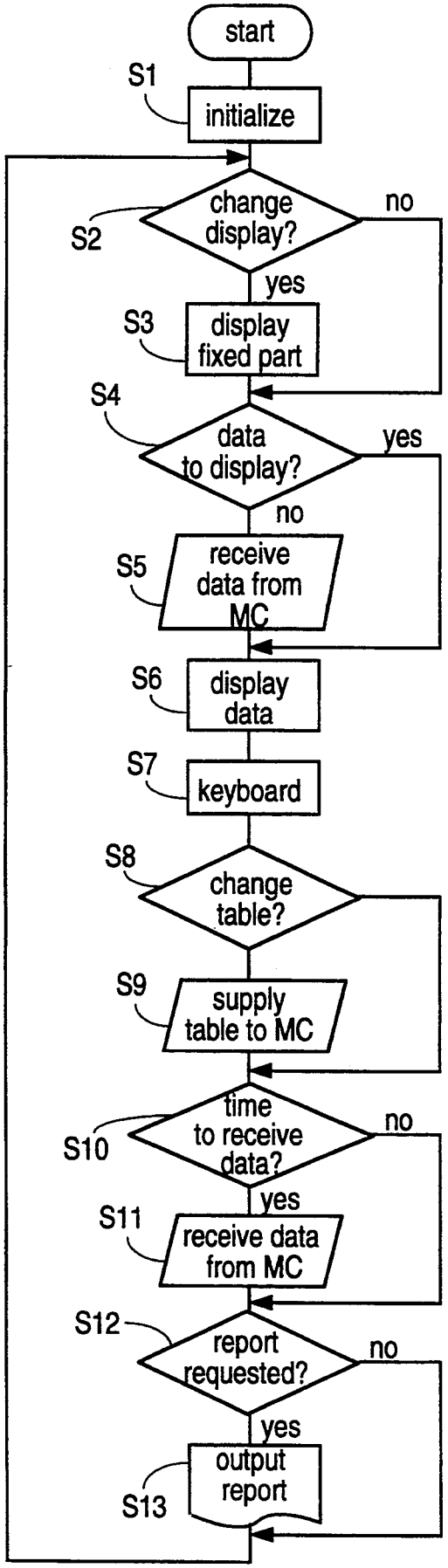
FIGS. 3 through 6 are flow charts showing the operation of a nitrogen oxides removal device applied to the boiler according to the present invention.

The flow chart of FIG. 3 shows the basic operation of the host computer 60. First of all, after conducting an initialization process in step S1, it is determined in step S2 if it is necessary to change the contents of the display on the display unit of the host computer 60. If there is no need to change the display, the program flow simply advances to step S4. If the display needs to be changed, only the fixed part of the display is kept displayed in step S3, and the program flow advances to step S4.

It is then determined in step S4 if the host computer 60 already has data to be displayed, and if there is any data to be displayed, the program flow advances to step S6. If there is no data to be displayed, the host computer 60 receives data to be displayed according to the procedure contained in step S33 in the flow chart of FIG. 4 from the main controller 56. In step S6, the data to be displayed either already stored in the host computer S90 or received from the main controller 56 is displayed on the display unit as a variable part of the display in combination with the aforementioned fixed part of the display.

In step S7, the operation modes for the mixing controllers 61 through 63, and information on the flow rates of the treatment agents (in case of manual operation) are entered in the host computer from the keyboard. It is then determined in step S8 if it is necessary to change the operation map used in the main controller 56. If the map does not need to be changed, the program flow simply advances to step S10. If the map needs to be changed, the new map is transmitted to the main controller 56 in step S9 before the program flow advances to step S10. The operation table determines the ratios of the treatment agents that are to be mixed in the mixing modules 30 through 32, and the amounts of injection from the injectors according to the temperature levels near the respective injectors, and the load (fuel flow rate) of the boiler 1.

In steps S10 and S11, if it is the time for collecting data from the mixing controllers 61 through 63, the sensors and the switches, and receiving the data edited by the main controller 56, such a communication process is executed. If a report on the amounts of different treatment agents is requested by the operator, such a report is printed out on the printer in steps S12 and S13 before the program flow returns to step S2. The process of steps S2 through S13 is repeated thereafter.

Figure 4:
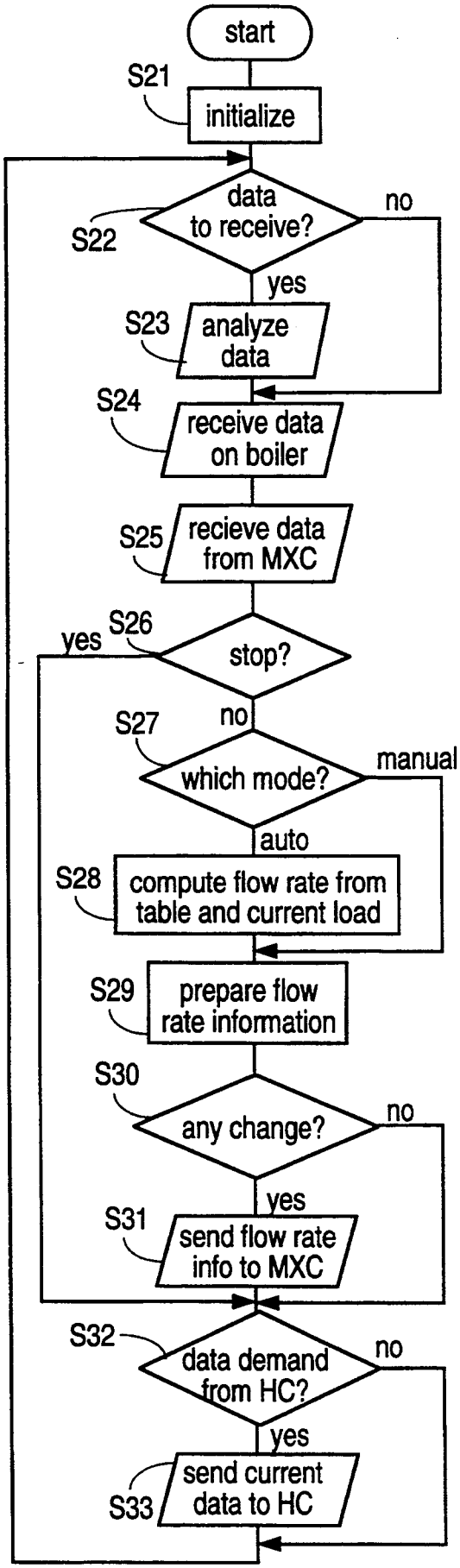

FIG. 4 is a flow chart showing the operation of the main controller 56 which is capable of displaying information and entering data much in the same way as the host computer 60 if it connected to a display unit, a printer and other peripheral equipment.

After an initialization process is conducted in step S21, it is determined in step S22 if synchronizing the clock with the host computer 60, and receiving programs, data and tables from the host computer 60 are required, or, in other words, if a system start-up process is to be conducted. It is also determined if the programs, data and tables already stored in the main controller 56 are required to be changed. If no communication with the host computer 60 is required, the program flow advances to step S24. If such a communication is required, data is received from the host computer 60 or the mixing controllers 61 through 63 and is edited in step S23, as required, before the program flow advances to step S24. In steps S24 and S25, information on the boiler and current data on the mixing controllers 61 through 63 are received. It is then determined in step S26 if the operation of the nitrogen oxides removal device is to be terminated or not. If so, the program flow advances to step S32. If not, the program flow advances to step S27.

In step S27, it is determined if the operator has set the mode to either manual or auto, and if the manual mode is selected, flow rate information is prepared according to the information entered from the keyboard in step S29. If the auto mode is selected, a flow rate calculation is conducted in step S28 according to the current load received in step S24 and the operation table. In step S30, it is determined if there is any change in the flow rate information prepared in step S29 from the preceding information, and if there is any change, the flow rate information is transmitted to the mixing controller 61 in step S31. Otherwise, the program flow advances to step S32.

In step S32, it is determined if there is any demand for data from the host computer 60, and if there is any such demand, the current data is transmitted to the host computer 60 in step S33. Then, the program flow returns to step S22, and the process of steps S22 through S33 is repeated thereafter.

Figure 5:
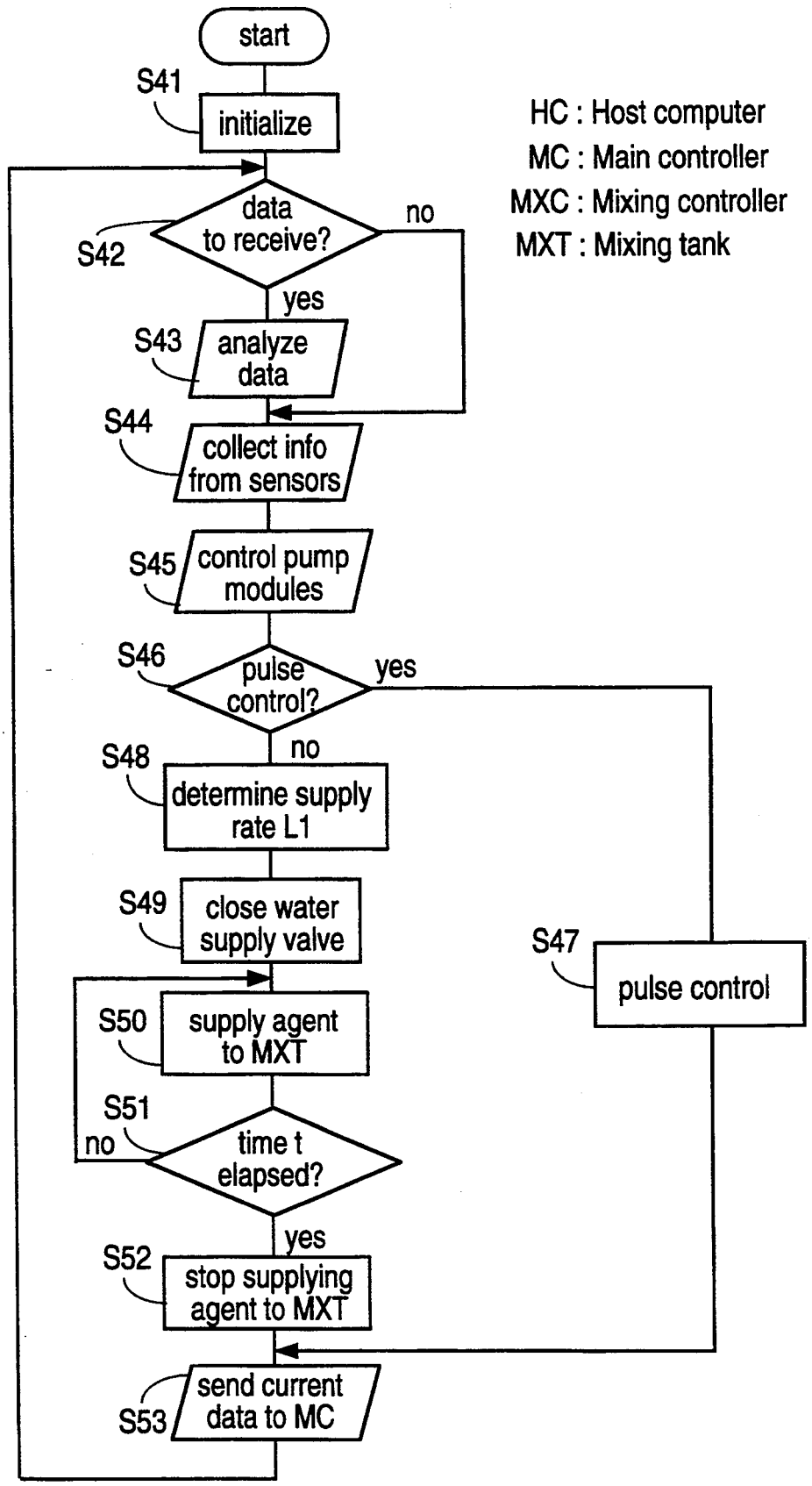
Figure 6:
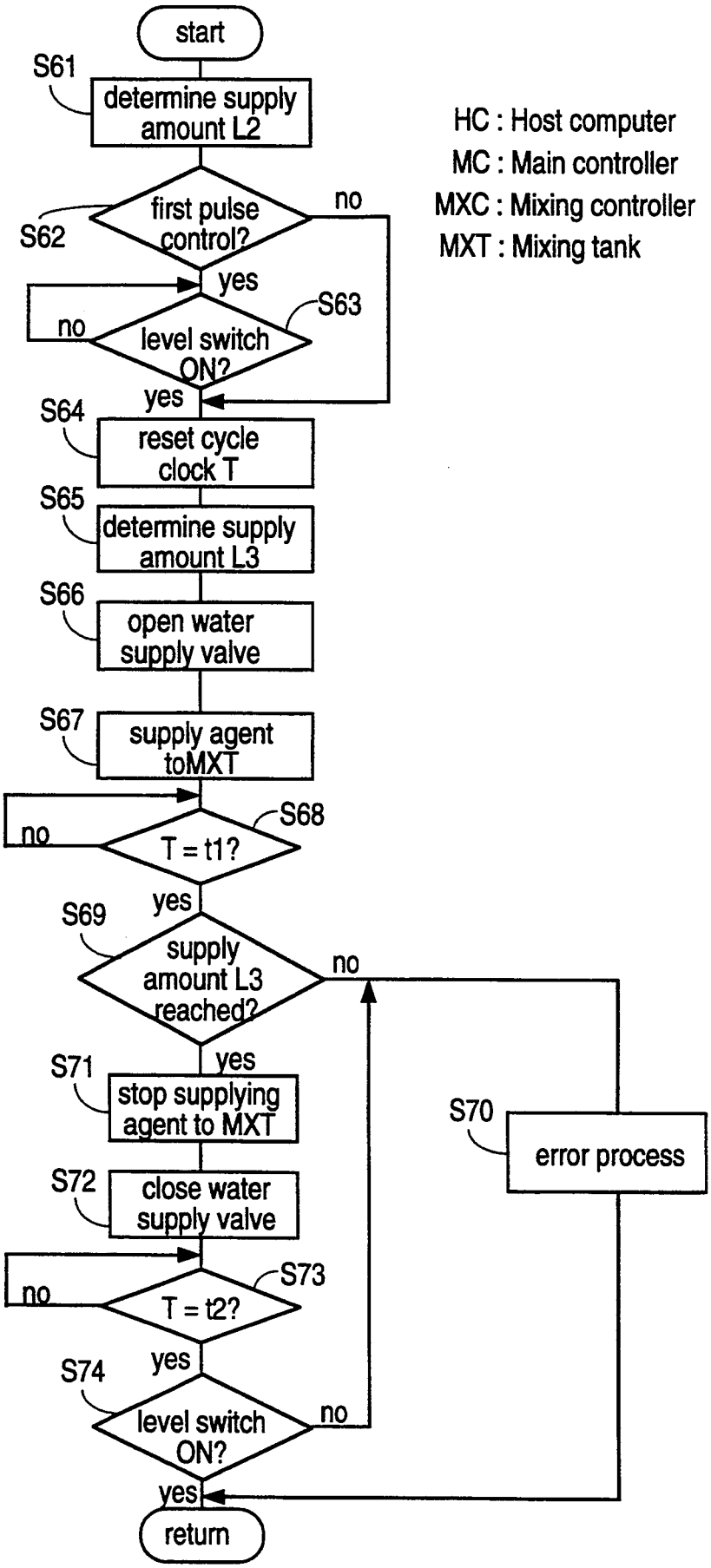

FIGS. 5 and 6 show the operation of the mixing controllers 61 through 63. Each of the mixing controllers comprises the main body having a capability to communicate with the main controller 56, and to display information when a display unit is connected thereto.

Following the initialization process of step S41, it is determined in step S42 if there is any data to be received, and if there is such data, the data is received and analyzed in step S43. If it is determined in step S44 that this process is not the first cycle process, data on the load of the boiler 1, temperatures, concentrations of ammonia, nitrogen oxides, and carbon dioxide, and flow rates and pressures of various conduits is collected and stored. Then, in step S45, the flow rates of the treatment agents are adjusted by controlling the pump 9 or 10 of each of the pump modules 7 and 8 according to the flow rate information received from the main controller 56, and the mixture ratios in the mixing tanks of the mixing modules are adjusted.

In step S46, it is determined if the pulse control which is described hereinafter is going to be used, and if that is the case, step S47 or the subroutine of FIG. 6 is executed. If the pulse control is not going to be used, the program flow advances to step S48.

The following description of the process in steps S48 through S53 will be with reference to the mixing module 13 illustrated in FIG. 2, and corresponding description of the operation of the mixing modules 14 and 15 are omitted to avoid unnecessary redundance.

The amount of supply to each of the injectors 33 through 35 per unit time t is determined in step S48, and the solenoid valve 25 of the utility water supply conduit 23 is closed in step S49 (FIG. 2). If there is any treatment agent in the mixing tank 20, it flows into the conduit 23 via the conduit 28, and is supplied to the pump 26. Substantially at the same time, the solenoid valves 21, 22 and 24 of the conduits 11*a*, 12*a* and 23*a* are opened in step S50 so that the respective treatment agents may be continually supplied to the mixing tank, and, in this step and the subsequent step S51, the treatment agent is continually supplied only from the mixing tank 20 to the injectors for a unit time period t. In step S52, the solenoid valves 21, 22 and 24 are closed and the supply of the treatment agent is stopped. In step S53, current data from each of the sensors is transmitted to the main controller 56, and the program flow returns to step S42.

Meanwhile, if it is determined in step S46 that the pulse control is going to be used, the program flow then advances to step S47 where the subroutine given in FIG. 6 is executed. In other words, an amount of supply for each injector during each cycle L1 is determined in step S61, and it is determined in step S62 if the pulse control routine is started from the current cycle. If that is the case, it is determined in step S63 if the level switch 77 in the mixing tank 20 is on. Otherwise, or if the mixing tank 20 still contains the treatment agent, the step S63 is repeated until the mixing tank 20 becomes empty and the level switch 77 of the mixing tank 20 is turned on before the program flow advances to step S64. Although not shown in the flow chart, if the level switch 77 remains off for more than a prescribed time period, an error process is initiated and an appropriate message is displayed on the display unit of the host computer 60. In step S64, the cycle clock T is reset, and the program flow advances to step S65.

The amount of supply of utility water L3 is computed from the amount of supply to each of the injectors L2 and the concentration of the treatment agent in the mixing tank 20 in step S65, and the solenoid valve 25 of the utility water supply conduit 23 is opened in step S66. As a result, the pressure of the utility water closes the one-way valve 29 of the conduit 28, and the bottom of the mixing tank 20 is closed. Substantially at the same time as step S66, the treatment agents are supplied the mixing tank 20 according to the computed amounts L2 and L3 in step S67.

Then, it is determined in step S68 if the cycle clock T has measured a time period t1, which may be equal to 10 seconds, for instance, and step S68 is repeated until this time period is measured by the cycle clock T. Once this time period has been measured, the program flow advances to step S69 where it is determined if the amount of supply L3 computed in step S64 has been reached according to the outputs from the flow rate sensors 71, 74 through 76. If the amount of supply L3 has not been reached, an error process is carried out in step S70 and the program flow returns to step S42 shown in FIG. 5. If the amount of supply L3 has been reached, the program flow advances to step S71.

In step S71, the solenoid valves 21, 22 and 24 are closed, and the supply of the treatment agents is stopped, and the program flow then advances to step S72 where the mixed treatment agent in the mixing tank 20 is supplied to the pump 26 by closing the solenoid valve 25. It is determined in step S73 if the cycle clock T has measured a prescribed time period t2, and if this time period has not yet been measured, step S73 is repeated. Once this time period has been measured, the program flow advances to step S74.

In step S74, it is determined if the level switch 77 has been turned on or not. If the level switch 77 has been turned on, the program flow returns to step S42 shown in FIG. 5. If the level switch 77 is still turned off, an error process is executed before the program flow returns to step S42. Then, it is determined if there has been any change in the control conditions for steps S42 through S46, and depending on the nature of the changes which took place, the process in steps S48 through S52 or in steps S61 through S74 is repeated. In the present embodiment, for each cycle (steps S61 through S74), it is determined in step S42 if there have been any changes in the control information for each of the mixing controllers 61 through 63 from the main controller 56, but it is also possible to continually check whether there have been any changes by using a multitask process, and change the parameters t1, t2, L2 and L3 for each half cycle (steps S61 through S68 and steps S69 through S74) whenever there has been a change.

In this way, the various valves and motors are controlled as a feedback process so as to maintain the concentrations of nitrogen oxides and ammonia within prescribed ranges by the host computer 60, the main controller 56 and the mixing controllers 61 through 63 according to the combustion condition of the boiler 1. Further, the conditions of the control process may be adjusted manually and remotely from the host computer 60 or the main controller 56, and the state of the control process may be allowed to be accessed from the host computer 60 or the main controller 56.

Figure 7:
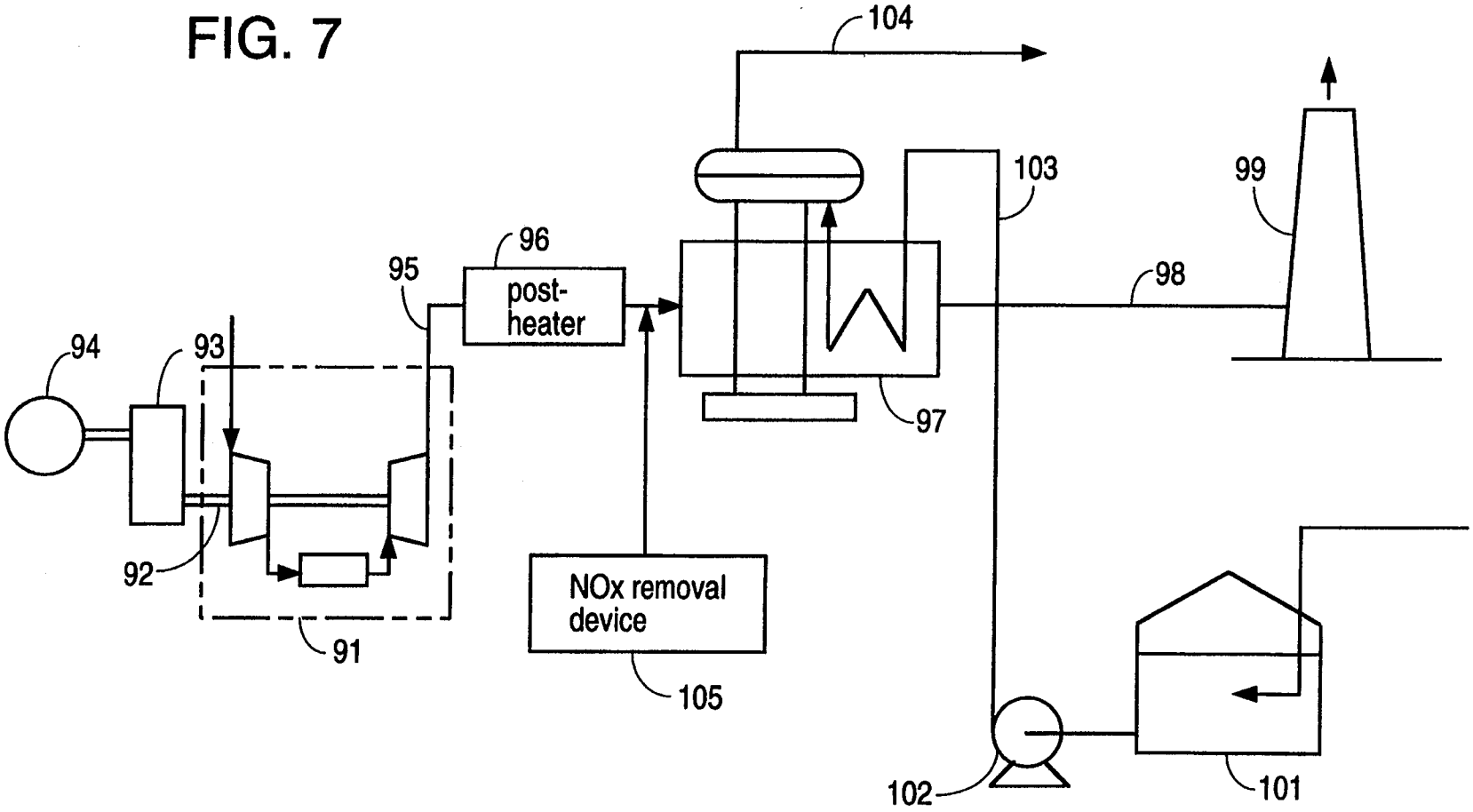
FIG. 7 is a schematic diagram of a co-generation system to which the present invention is applied.

FIG. 7 is a simplified diagram of a second embodiment of the present invention. In this embodiment, the device and method for removing nitrogen oxides according to the present invention are applied to a co-generation system which employs a gas turbine 91.

The output shaft of the gas turbine 91 is connected to an electric generator 94 via a reduction gear 93. The exhaust passage 95 of the gas turbine 91 is connected to an exhaust gas boiler 97 via a post-heater 96. The exhaust gas which has passed through the exhaust gas boiler 97 is released to the atmosphere via a duct 98 and a smoke stack 99. Water is supplied from a water tank 101 to the exhaust gas boiler 97 via a pump 102 and a conduit 103, and is converted into steam by receiving heat from the exhaust gas. The steam thus obtained is distributed to users via a conduit 104.

The nitrogen oxides removal device 105 of the present invention is placed in a part of the passage 95 between the post-heater 96 and the exhaust boiler 97, and a plurality of injectors are installed in this passage. The construction of this nitrogen oxides removal device 105 and the operation method thereof may be substantially same as those of the preceding embodiment.

According to this embodiment, even when the temperature of the exhaust gas immediately after it is ejected from the gas turbine 91 is relatively low, it may be heated with the post-heater 96, for instance, to the temperature of 850° C. or higher, and the nitrogen oxides removal device 105 of the present invention can therefore effectively remove nitrogen oxides from the exhaust gas.

The present invention can be equally applied to other internal and external combustion engines such as diesel and gasoline reciprocating engines.

Thus, according to the present invention, the concentrations of the treatment agents having the capability to chemically reduce nitrogen oxides, and the amount of supply of the treatment agents to the injectors can be controlled at high speed in an optimum fashion according to the combustion conditions such as combustion temperature, the load of the combustion device, the concentration of a component in the exhaust gas and so forth. Further, the structure for adjusting the flow rate of each of the treatment agents can be simplified and reduced in size.

When a plurality of treatment agents are to be combined, by mixing them while water is being sprayed into the exhaust gas, a high responsiveness to the change in the optimum mixing ratio of the nitrogen oxides removal device at each time point can be achieved, and the size of the mixing tank may be reduced. The reduction in the size of the mixing tank obviously contributes to the reduction of the overall size of the system.

Although the present invention has been described in terms of preferred embodiments thereof, it is obvious to a person skilled in the art that various alterations and modifications are possible without departing from the scope of the present invention which is set forth in the appended claims.

What we claim is:

1. A device for removing nitrogen oxides form exhaust gas of a combustion device including a combustion chamber and an exhaust passage, by spraying a treatment agent from an injector into said combustion device, said treatment agent being capable of chemically reducing nitrogen oxides contained in said exhaust gas, comprising:

means for detecting a combustion condition of said combustion device;

a water supply;

a tank for storing said treatment agent;

pump means having an inlet connected to said water supply and to said tank and an outlet connected to said injector;

switching means, connected to said inlet of said pump means, for selectively supplying either water or said treatment agent to said inlet; and means for controlling said switching means according to said combustion condition detected by said detecting means.

2. A device according to claim 1, wherein said detecting means comprises means for detecting the concentration of at least one component in said exhaust gas.

3. A device according to claim 1, wherein said detecting means comprises means for detecting the temperature of said exhaust gas in the vicinity of said injector.

4. A device according to claim 1, wherein said detecting means comprises means for detecting a load condition of said combustion device.

5. A device according to claim 1, wherein said combustion device comprises a post-heater provided in an exhaust passage of an internal combustion engine.

6. A device according to claim 1, wherein said injector sprays a treatment agent into the combustion chamber of said combustion device.

7. A device according to claim 1, wherein said injector sprays a treatment agent into the exhaust passage of said combustion device.

8. A device for removing nitrogen oxides from exhaust gas of a combustion device including a combustion chamber and an exhaust passage, by spraying a treatment agent from an injector into said combustion device, said treatment agent being capable of chemically reducing nitrogen oxides contained in said exhaust gas, comprising:

means for detecting a combustion condition of said combustion device;

a water supply;

at least two storage tanks for storing a first treatment agent and a second treatment agent, respectively;

first pump means for feeding said first treatment agent and said second treatment agent to a mixing tank for mixing and storing said treatment agents in said mixing tank;

second pump means having an inlet connected to said water supply and to said mixing tank and an outlet connected to said injector;

switching means, connected to said inlet of said second pump means, for selectively supplying either water or said treatment agent to said inlet; and means for controlling the feed rates of said first and second treatment agents to said mixing tank by said first pump means, and the operation of said switching means according to said combustion condition detected by said detecting means.

9. A device according to claim 1, wherein said injector sprays a treatment agent into the combustion chamber of said combustion device.

10. A device according to claim 8, wherein said injector sprays a treatment agent into the exhaust passage of said combustion device.

11. A device according to claim 8, further comprising:

third pump means having an inlet connected to said water supply and an outlet connected to said mixing tank; and means for controlling the feed rate of water to said mixing tank by said third pump means according to said combustion condition detected by said detecting means.

12. A method for removing nitrogen oxides from exhaust gas of a combustion device including a combustion chamber and an exhaust passage, by spraying a treatment agent from an injector into said combustion device, said treatment agent being capable of chemically reducing nitrogen oxides contained in said exhaust gas from said combustion device, comprising the steps of:

detecting a combustion condition of said combustion device; and supplying water and at least one treatment agent in a selective and alternating manner to said injector according to said detected combustion condition.

13. A method according to claim 12, wherein a treatment agent mixture is prepared by mixing a plurality of components while water is being supplied to said injector.

14. A device according to claim 12, wherein said injector sprays a treatment agent into the combustion chamber of said combustion device.

15. A device according to claim 12, wherein said injector sprays a treatment agent into the exhaust passage of said combustion device.

16. A method for removing nitrogen oxides from exhaust gas of a combustion device including a combustion chamber and an exhaust passage, by spraying a treatment agent from an injector into said combustion device, said treatment agent being capable of chemically reducing nitrogen oxides contained in said exhaust gas from said combustion device, comprising the steps of:

detecting one of at least two combustion conditions of said combustion device; and supplying water to said injector according to a first detected combustion condition; and supplying at least one treatment agent to said injector according to a second detected combustion condition.

17. A method according to claim 10, wherein said injector sprays a treatment agent into the combustion chamber of said combustion device.

18. A method according to claim 16, wherein said injector sprays a treatment agent into the exhaust passage of said combustion device.

* * * * *